US007034279B2

(12) United States Patent
Ruiz et al.

(10) Patent No.: US 7,034,279 B2
(45) Date of Patent: Apr. 25, 2006

(54) METHOD AND SYSTEM FOR PRINTHEAD ROTATION DETECTION USING PHOTOSENSORS

(75) Inventors: Rodrigo Ruiz, Terrassa (ES); Carles Flotats, Barcelona (ES); Francesc Subirada, Castellbisbal (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 383 days.

(21) Appl. No.: 10/672,913

(22) Filed: Sep. 25, 2003

(65) Prior Publication Data

US 2005/0067558 A1 Mar. 31, 2005

(51) Int. Cl.
*H01J 40/14* (2006.01)

(52) U.S. Cl. ..... 250/221; 250/559.37

(58) Field of Classification Search ..... 250/559.32, 250/559.37, 559.29; 347/32, 38, 41
See application file for complete search history.

(56) References Cited

U.S. PATENT DOCUMENTS

2005/0024414 A1* 2/2005 Chong Hin ..... 347/19

* cited by examiner

*Primary Examiner*—Georgia Epps
*Assistant Examiner*—Tony Lu
(74) *Attorney, Agent, or Firm*—Wiesner & Associates; Leland Wiesner

(57) ABSTRACT

A method and apparatus is used to detect and compensate for printhead rotation in an inkjet printer. The detecting operation includes receiving an initial image of a pattern taken from a medium as the printhead passes over the medium, receiving a subsequent image of the pattern taken from the medium as the printhead continues to pass over the medium, comparing the initial image of the pattern and the subsequent image of the pattern taken from the medium and identifying a rotation of the printhead in the inkjet printer passing over the medium if the comparison indicates the initial image of the pattern is rotated relative to the subsequent image of the pattern. The compensation operation includes modifying the timing settings associated with the firing of the nozzles in the inkjet printhead to compensate for the rotation of the printhead.

31 Claims, 6 Drawing Sheets

METHOD AND SYSTEM FOR PRINTHEAD ROTATION DETECTION USING PHOTOSENSORS

BACKGROUND OF THE INVENTION

The present invention relates to the use of image processing and printing.

In a scanning inkjet printer, an inkjet printhead mounted to a carriage moves back and forth across a media. The printhead and carriage assembly is typically guided across the media using one or more carriage guide bars to keep the printhead and carriage assembly properly aligned. During each pass of the printhead and carriage, a control device selectively activates one or more drop generators to eject ink droplets from nozzles in the inkjet printhead and deposit them on the underlying media forming text characters and images.

To print accurately and at higher resolutions, it is important to keep various parts of the inkjet printhead and carriage properly aligned. In particular, the printhead and carriage often experience a rotation about the z-axis perpendicular to the carriage direction due to imperfections in the carriage guide bars. In a large format printer, the printhead and carriage is typically guided by at least two such carriage guide bars. Nonetheless, even two such carriage guide bars are not sufficient to prevent small rotations by the printhead and carriage about the z-axis (the theta-z) direction. While the rotations in the printhead and carriage assembly are reduced, they still are sufficient to create undesirable and noticeable artifacts when printing.

Conventional solutions used to address printhead rotation and other printer alignment issues involve printing and scanning specialized marks. Typically, a specialized mark is developed for each of alignment problem being addressed. In the case of the printhead rotation described above, a specialized mark would be developed to detect the degree of printhead rotation in a given inkjet printer. In a separate calibration operation this specialized mark is then printed in a first pass on a media and then, on a second pass, the relative position of the specialized mark is detected for later analysis and correction of printer detects using either a scanning device built into the inkjet or other types of feedback mechanisms.

These conventional solutions for detecting and correcting the printhead and carriage rotation have several drawbacks. Printing and scanning these marks takes a great deal of time as the mark must first be printed and then later be scanned on separate passes of the inkjet printer. Even if performed properly, alignment performed using these marks is a singular event that generally occurs between print jobs, printhead replacement and other events. Environmental and operational factors that also affect alignment include varying environmental conditions of temperature and humidity as well as changes in the lubrication of the printer, friction, and overall printer usage.

Unfortunately, the dynamic changes in the printhead and carriage rotation are not adequately addressed using the static conventional alignment detection methods. As a consequence, compensating for printhead rotation is limited to information collected at the time of calibration rather than the moment changes in the printer or printer environment occur. Even if it were possible, it is not cost effective to use these conventional methods as frequently as necessary; it would also result in a great deal of wasted media. Accordingly, there is a need to improve the detection of printhead rotation in the theta-z direction if more optimal printed output is desired.

BRIEF DESCRIPTION OF THE DRAWINGS

Like reference numbers and designations in the various drawings indicate like elements.

SUMMARY OF THE INVENTION

One aspect of the present invention provides a method of detecting and compensating for printhead rotation in an inkjet printer. The detecting operation includes receiving an initial image of a pattern taken from a medium as the printhead passes over the medium, receiving a subsequent image of the pattern taken from the medium as the printhead continues to pass over the medium, comparing the initial image of the pattern and the subsequent image of the pattern taken from the medium and identifying a rotation of the printhead in the inkjet printer passing over the medium if the comparison indicates the initial image of the pattern is rotated relative to the subsequent image of the pattern. The compensation operation includes modifying the timing settings associated with the firing of the nozzles in the inkjet printhead to compensate for the rotation of the printhead.

DETAILED DESCRIPTION

Aspects of the present invention are advantageous in at least one or more of the following ways. Implementations of the present invention detect and compensate for rotations of an inkjet printhead quickly and efficiently. One or more photosensor arrays operatively coupled to the printhead pass in the carriage direction during printing and gather snapshots of a pattern on the underlying media. Different relative positions of the pattern are analyzed and used to determine if the printhead carriage has rotated about the z-axis while passing over the media—the z-axis is a perpendicular axis to the carriage direction while the theta-z (θz) direction describes a rotation around the z-axis. Printhead rotation is compensated for by altering or modifying the timing in which the inkjet nozzles fire onto the media.

Implementations of the present invention can perform these operations in a single pass. This is a significant advance over conventional solutions that require at least two passes to perform a calibration or adjustment. For example, conventional solutions typically print a specialized test pattern in a first pass and then a subsequent pass scans the specialized test pattern before analyzing the results. Further, the present invention can detect and compensate for printhead rotation one time or many times as the printhead passes in the carriage direction.

Further, implementations of the present invention detect and compensate for printhead rotation during printing dynamically. The printhead rotation detected and compensated for can be caused by operating characteristics like temperature, friction and printing speed, imperfections in the carriage guide bars and other factors. This is a significant improvement over static calibration operations that occur at a calibration point prior to printing.

Figure 1:
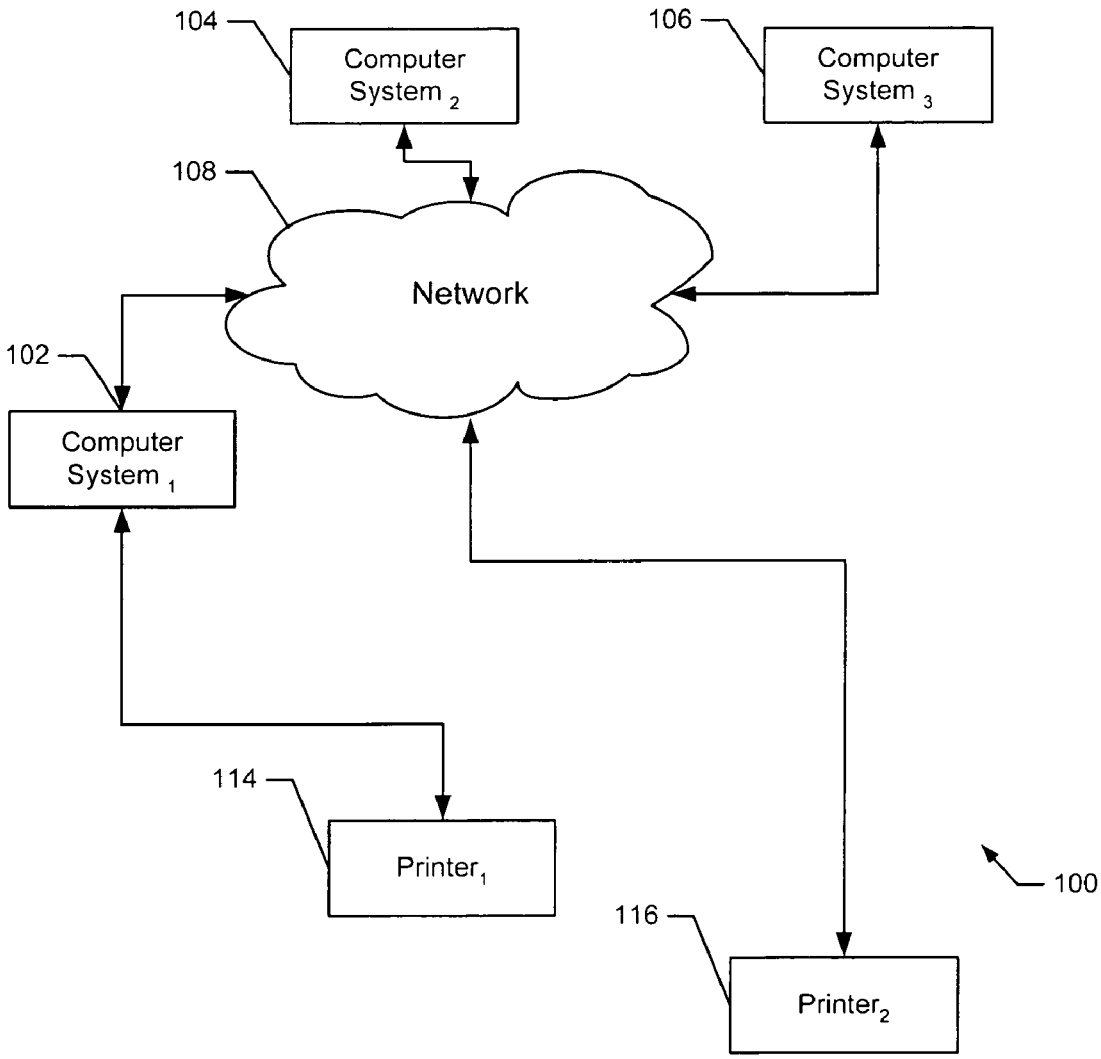
FIG. 1 is a block diagram representation of a system using printers designed in accordance with one implementation of the present invention.

Referring now to FIG. 1 is a block diagram representation of a system using printers designed in accordance with one implementation of the present invention. System 100 includes computer system$_1$ 102, computer system$_2$ 104, and computer system$_3$ 106 having access to one or more printers over network 108 including printer$_1$ 114 and printer$_2$ 116. In the implementation depicted in FIG. 1, printer$_1$ 114 is directly connected to an input/output port of computer system$_1$ 102 while printer$_2$ 116 is connected over network 108 to the one or more computers having access to network 108 and loaded with the proper drivers and applications. Accordingly, computer system$_1$ 102, computer system$_2$ 104, and computer system$_3$ 106 have direct access to printer$_2$ 116 and indirect access to printer$_1$ 114 through computer system 102.

Printer$_1$ 114 and printer$_2$ 116 utilize implementations of the present invention to detect the rotation of a printhead in the theta-z direction and compensate for this rotation by modifying the timing of the nozzles firing ink from the printhead. This prevents the rotation in the printhead from distorting the printed output produced by either printer$_1$ 114 or printer$_2$ 116. In contrast, a printer without the present invention would produce distorted output. For example, a conventional printer and alignment solution attempting to print a long vertical line in the media feed direction may create a series of segments close to the vertical axis but disjointed from swath to swath due to a rotation in the inkjet printhead in the z-axis.

Implementations of the present invention are particularly helpful when printing on large format printers with roll fed mediums. In large format printers, print jobs may be larger and a small rotation of the printhead about the z-axis, if not immediately corrected, could quickly ruin the print job and expensive media. It is also useful on smaller format inkjet printers with cut-sheet and other print medium delivery mechanisms when it is particularly inconvenient or difficult to deal with a rotated printhead during printing. Examples of printing mechanisms that may also embody the present invention include office and desk top printers, copiers, facsimile machines, and the like.

Figure 2:
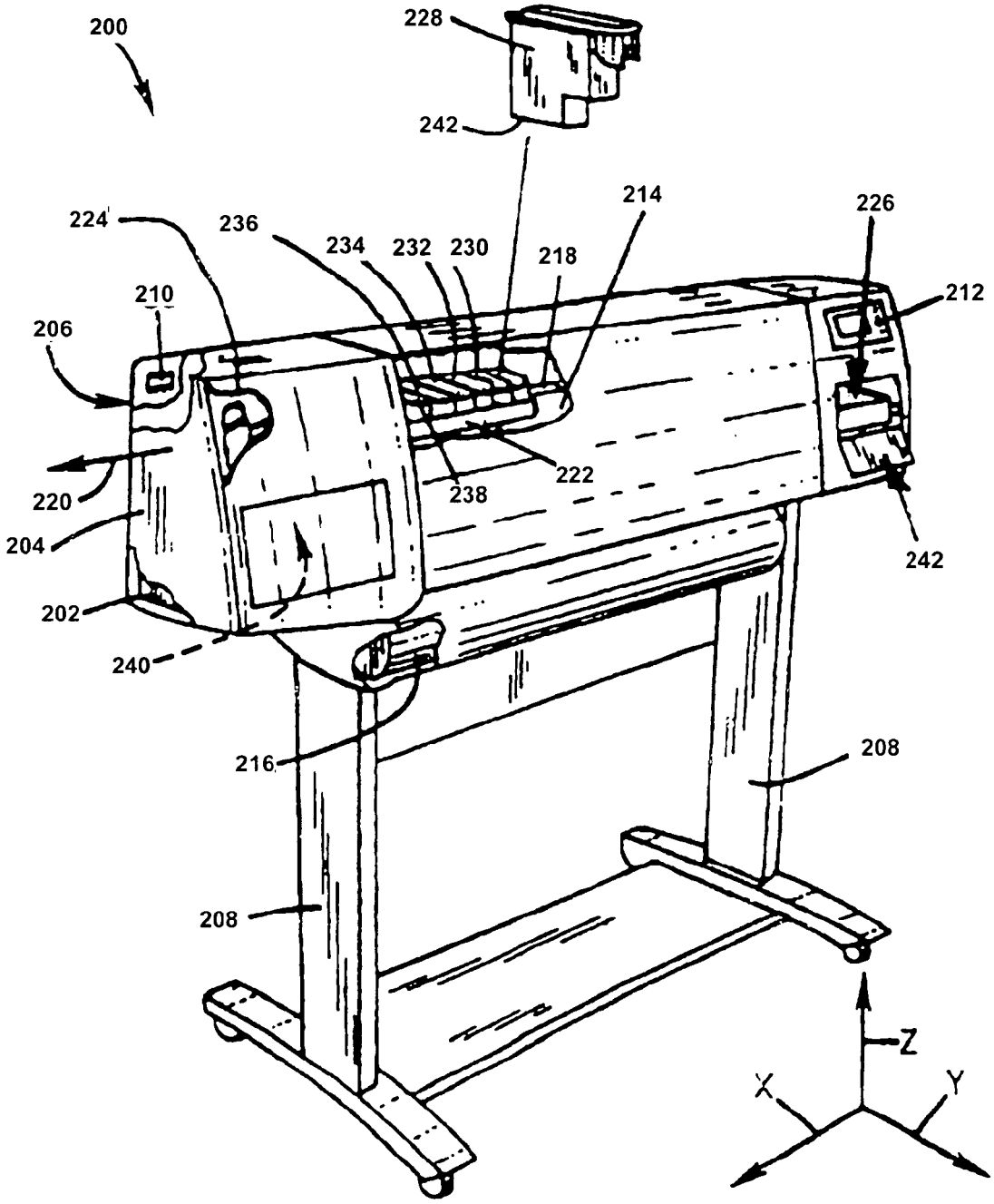
FIG. 2 illustrates an example large format inkjet printer suitable for use with the implementations of the present invention.

Accordingly, FIG. 2 illustrates a large format inkjet printing mechanism, here shown as an inkjet printer 200, which is suitable for use with the implementations of the present invention. Inkjet printer 200 is a large format printer that may be used for printing conventional engineering and architectural drawings, as well as high quality poster-sized images, and the like, in an industrial, office, home or other environment.

While it is apparent that the printer components may vary from model to model, inkjet printer 200 typically includes a chassis 202 surrounded by a housing or casing enclosure 204, typically of a plastic material, together forming a print assembly portion 206 of printer 200. Although print assembly portion 206 may be supported by a desk or tabletop, it is preferred to support the print assembly portion 206 with a pair of leg assemblies 208.

Printer 200 also has a printer controller 210, illustrated schematically as a microprocessor that receives instructions from a host device, which is typically a computer, such as a personal computer or a computer aided drafting (CAD) computer system (not shown). Printer controller 210 may also operate in response to user inputs provided through a key-pad and status display portion 212, located on the exterior of casing 204. Printer controller 210 has associated memory (not shown), which may include ROM, RAM and a non-volatile data storage module, such as a high capacity hard disk drive. In this manner, image data to be printed may be stored when it is downloaded from the host device. In one implementation of the present invention, printer controller 210 performs the operations for detecting a printhead rotated about the z-axis and modifying the timing of the ink ejected from the nozzles in the printhead to compensate accordingly. Alternatively, these detecting and compensation operations may be performed on the host device and transmitted to printer 200 over a communication port on printer 200.

A monitor coupled to the computer host may also be used to display visual information to an operator, such as the printer status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 216 from a roll through a printzone 214. Print media 216 may be any type of suitable sheet material, such as paper, poster board, fabric, transparencies, Mylar™, and the like.

At least one carriage guide rod 218 is mounted to chassis 202 defining a scanning axis 220, with carriage guide rod 218 slideably supporting an inkjet carriage 222 for travel back and forth, reciprocally, across printzone 214. A conventional carriage drive motor 224 may be used to propel carriage 222 in response to a control signal received from controller 210. To provide carriage positional feedback information to the controller 210, a conventional encoder strip (not shown) may be extended along the length of the printzone 214 and over a servicing region 226, which is accessible to the user via an access panel 242.

In printzone 214, the media sheet receives ink from an inkjet cartridge, such as a black ink cartridge 228, an enlarged view of which is shown in FIG. 2, and five monochrome color ink cartridges 230, 232, 234, 236 and 238. In this example, each of the cartridges, often called "pens" by those in the art, is mounted on inkjet carriage 222. Cartridges 230, 232, 234, 236 and 238 are each arranged to print one of the following color inks: cyan; magenta; yellow; light cyan; and, light magenta. In one implementation, each of the pens 230, 232, 234, 236 and 238 contains dye-based ink although in alternative implementations pigment based ink could also be used. Alternate implementations may also use pens having several ink cartridges rather than a single monochromatic cartridge as illustrated in FIG. 2.

Pens 230, 232, 234, 236 and 238 illustrated each have a printhead (of which only printhead 242 of the pen 228 is illustrated in FIG. 2), which selectively ejects ink to form an image on media 216 in printzone 214. Each printhead has an orifice plate with a plurality of nozzles formed therethrough in a manner well known to those skilled in the art. The nozzles of each orifice plate are typically formed in at least one, but typically two generally linear arrays along the orifice plate. These inkjet printheads have a large print swath (i.e. the height of the band of a ink that may be printed in one pass of the printhead), for instance about 20 to 25 millimeters (about one inch) wide or wider, although smaller inkjet printheads may also be used.

As illustrated, printer 200 uses an "off-axis" ink delivery system, having main stationary reservoirs (not shown) for each ink color located in an ink supply region 240. In this off-axis system, the pens 230, 232, 234, 236 and 238 may be replenished by ink conveyed through a conventional flexible tubing system (not shown) from the stationary main reservoirs. In this manner, only a small ink supply is propelled by carriage 222 across printzone 214, which is located "off-axis" from the path of printhead travel.

In one implementation, the printheads are thermal inkjet printheads, although other types of printheads may be used, such as piezoelectric printheads, in alternate implementations. The thermal printheads typically include a plurality of resistors associated with the nozzles. Upon energizing a selected resistor, a bubble of gas is formed which ejects a droplet of ink from the nozzle and onto a sheet of media in printzone 214 under the nozzle. The printhead resistors are selectively energized in response to firing command control signals delivered from controller 210 to printhead carriage 222.

Figure 3A:
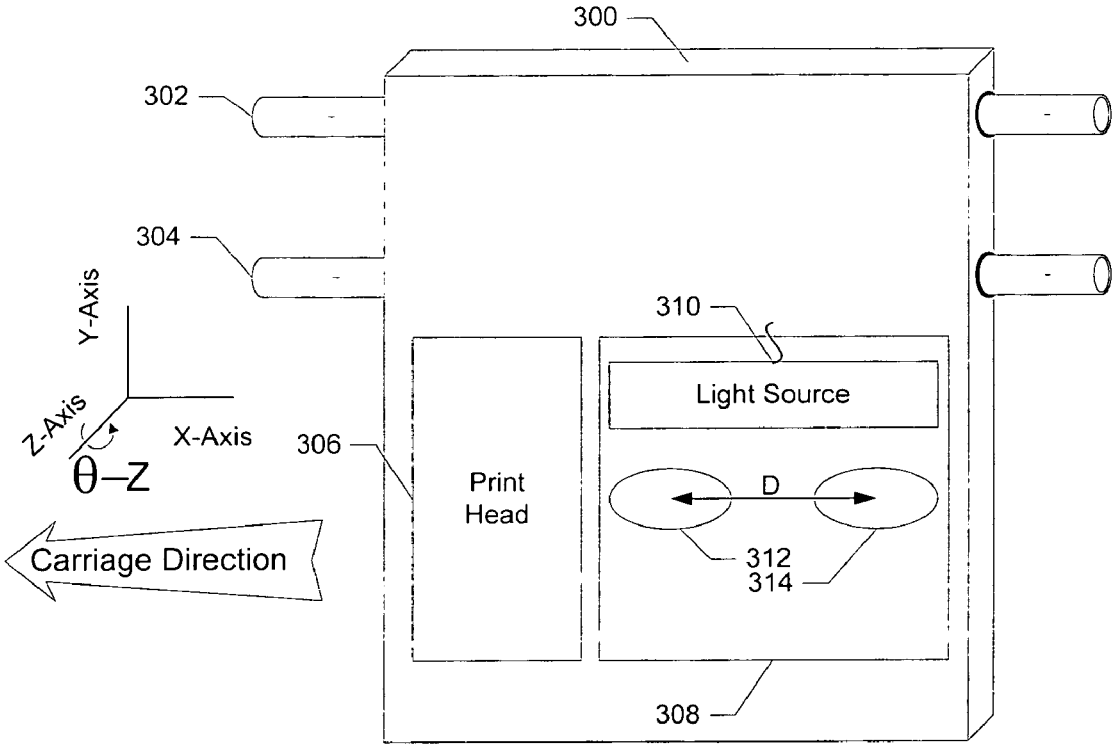
FIG. 3A is a schematic block diagram illustrating the underside of an inkjet carriage designed in accordance with one implementation of the print invention.

FIG. 3A is a schematic block diagram illustrating the underside of an inkjet carriage 300 designed in accordance with one implementation of the print invention. In this example, carriage 300 includes a first carriage guide 302, a second carriage guide 304, a printhead 306 and a medium advance sensor (MAS) 308. In this example, printhead 306 represents the one or more print heads used by the one or more pens held in inkjet carriage 300.

First carriage guide 302 and second carriage guide 304 function to direct carriage 300 across a media while printhead 306 ejects droplets of ink through nozzles in the inkjet printhead 306. In practice, however, printhead 306 tends to rotate slightly as it travels along first carriage guide 302 or second carriage guide 304 due to the guides not being perfectly straight, manufacturing limitations or tolerances used to manufacture the carriage guides, operating anomalies or other factors. Instead of traveling directly across the media, printhead 306 along with other aforementioned components in carriage 300 tends to rotate in the theta-z direction as a result. Unchecked, even a small rotation in theta-z direction is likely to degrade the appearance of an image being printed on the media by printhead 306.

To address this problem, implementations of the present invention detect the rotation in the theta-z direction and compensate by modifying the firing of the nozzles in printhead 306. In the implementation illustrated in FIG. 3A, MAS 308 gathers microscopic information and detects a pattern on the media as carriage 300 with printhead 306 pass over the media in the carriage direction. Operation of one MAS is described in U.S. Pat. No. 6,118,132 by Barclay, J. Tullis entitled, "System for Measuring the Velocity, Displacement and Strain on a Moving Surface or Web of Material" assigned to the assignee of the present invention and is herein incorporated by reference in the entirety (hereinafter "Tullis").

In this example, MAS 308 includes a light source 310, a first photosensor array 312 and a second photosensor array 314. During printing, light source 310 is directed toward the media thereby illuminating microscopic details of the media as carriage 300 passes overhead. First photosensor array 312 generates at a first instant an initial image of an area of the media surface. From this image, the pattern of the microscopic details in that area of the surface of the media is identified. At a second instance second photosensor array 214 obtains a subsequent image of the same pattern as MAS 308 is passing over approximately the same area on the media.

Figure 3B:
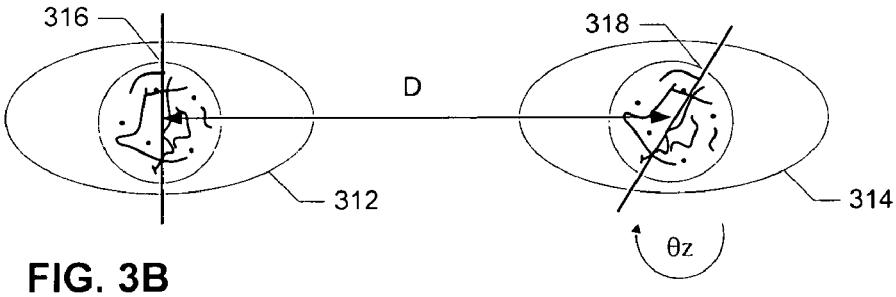
FIG. 3B is an example scenario illustrating a pattern in the initial image that is rotated in the theta-z direction in the subsequent image as gathered by two photosensors.

FIG. 3B is an example scenario illustrating a pattern in the initial image that is rotated in the theta-z direction in the subsequent image as gathered by two photosensors. In this example, the degree of rotation is exaggerated to better illustrate the overall operation even though much smaller movements in the theta-z direction could be detected by the present invention. Pattern 316 found in the initial image taken by first photosensor array 312 is at a first orientation while pattern 318, though otherwise identical to pattern 316, is rotated when second photosensor array 314 snaps the subsequent image containing the pattern. Rather than correct the rotation of the printhead in the theta-z direction, implementations of the present invention modifies the timing used to fire the nozzles in the one or more inkjet printheads in carriage 300. Of course, if the pattern in the initial image matches the orientation of the same pattern in the subsequent image, implementations of the present invention would determine that the carriage and printhead have not been rotated in the theta-z direction and not modify the timing used to fire the nozzles.

Figure 3C:
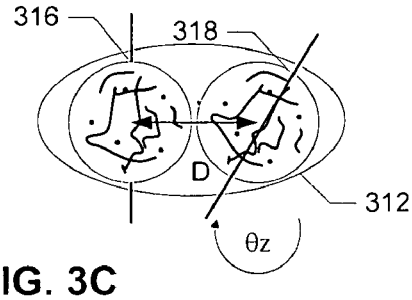
FIG. 3C illustrates one implementation of the present invention that uses a single photosensor array to detect the rotation of an image and a printhead in the theta-z direction.

In an alternate implementation, FIG. 3C illustrates a single photosensor array detecting the rotation of the pattern and printhead in the theta-z direction. In this implementation, one photosensor array 312 takes an initial image of a pattern 316 at a first instance and then takes a subsequent image of the same pattern 318, otherwise identical to pattern 316, except it has rotated in the theta-z direction after the one photosensor array 312 has traveled approximately a distance D across the media. This implementation of the present invention has the advantage being less expensive to implement as it only needs a single photosensor rather than two individual photosensors. It is also advantageous in that a single photosensor does not have the same alignment requirements needed between the pair of sensors described in the previous implementation. For example, aligning a pair of photosensors includes ensuring they are co-planar and have specific rotational positions to each other.

Figure 4A:
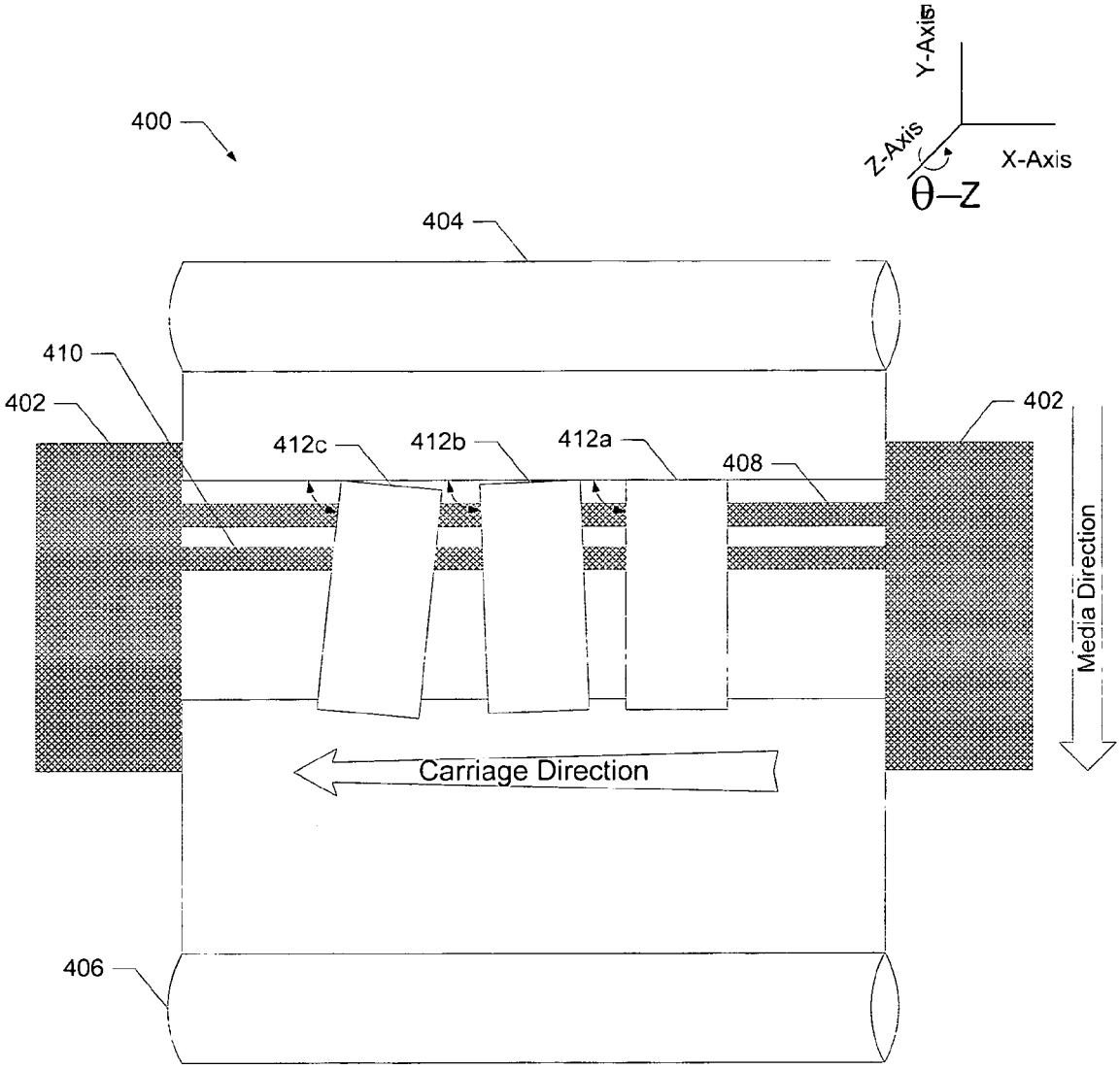
FIG. 4A depicts a portion of a large format printer capable of detecting a rotation of the printhead and compensating for the rotation during printing in accordance with one implementation of the present invention.

FIG. 4A depicts a portion of a large format printer capable of detecting a rotation of the printhead and compensating for the rotation during printing in accordance with one implementation of the present invention. Large format printer 400 includes printer base 402, supply media roll 404, take-up media roll 406, a first carriage guide 408 and a second carriage guide 410. In addition, FIG. 4A depicts an exaggerated schematic of the rotation carriage 412 (illustrated as carriage 412*a*, 412*b*, and 412*c* over time) may experience while traveling along first carriage guide 408 and second carriage guide 410 during a time period.

As depicted in FIG. 4A, supply media roll 404 provides media on the roll under carriage 412 in the indicated media direction to receive printed information and then be stored on take-up media roll 406. Supply media roll 404, however, does not move as carriage 412 passes over and inkjet printheads print on the media.

In operation, carriage 412 travels in the media direction guided by first carriage guide 408 and second carriage guide 410. Once again, carriage 412 tends to rotate slightly while traveling along the first carriage guide 408 and second carriage guide 410 due to the guides not being straight or slightly curved, alignment differences between the guides relative to each other and other factors as previously described. Consequently, carriage 412 tends to experience small rotations about the z-axis or experience a "θ-z" (Theta-Z) misalignment.

For example, carriage 412*a* initially may start traveling along carriage guides 408 and 410 without rotating. A short time later, carriage 412*b* may experience a first rotation in one direction and then at a subsequent time interval experience a second rotation in the opposite direction as exemplified by the relative position of carriage 412*c* to first carriage guide 408 and second carriage guide 410. As previously described, implementations of the present invention use one or more photosensors in a MAS (hidden from view) to detect the rotation of carriage 412 and the corresponding printheads as carriage 412 and printheads pass over the media material. Implementations of the present invention detects the different rotations of the carriage in the z-axis as it travels in the carriage direction and dynamically modifies the firing of the nozzles in the one or more printheads to compensate.

Figure 4B:
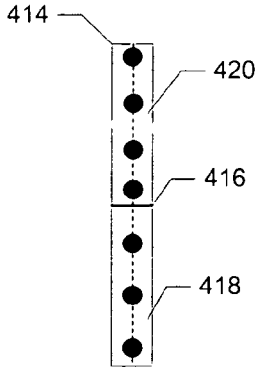
FIG. 4B illustrates a schematic of an example printhead portion and nozzles used to compensate for the inkjet printhead rotation.

FIG. 4B is a schematic of an example printhead portion 414 to illustrate how modifying the timing sequence for firing the nozzles compensates for the inkjet printhead rotation. While printhead portion 414 only provides one logical column of nozzles to describe aspects of the invention, it is contemplated that the same concepts can be applied to many different configurations of nozzles in a print head. Accordingly, nozzles in printhead portion 414 are arranged in a column and fired in a sequence as required by the information being printing. For example, if printhead 414 is not rotated along the theta-z direction, firing each inkjet nozzle with a standard delay produces a desired mark or line on the print media. The standard delay is related to the scan speed of the printhead and the physical offset between nozzles in one or more columns. However, if the present invention detects that printhead portion 414 is rotated along the theta-z direction then the standard delay used to fire each inkjet in printhead 414 is modified. For example, rotating the output from printhead portion 414 clockwise around an axis 416 includes gradually shortening the standard delay for firing nozzles in area 418 toward axis 416 and then increasing the delay for inkjets in area 420 while moving further away from axis 416. To rotate the output from printhead portion 414 in the counter-clockwise direction the delay strategy is reversed.

Figure 5:
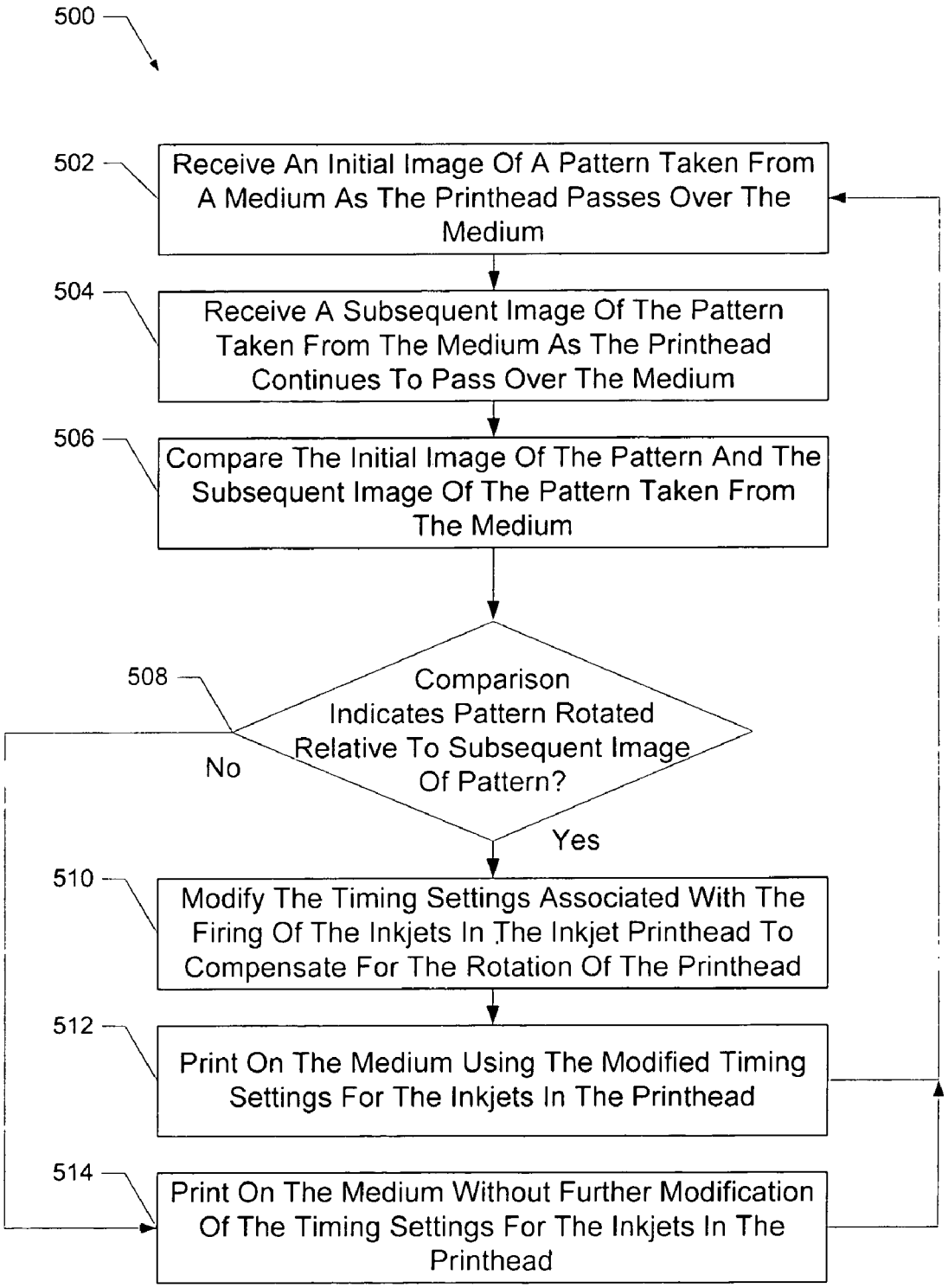
FIG. 5 provides a flowchart diagram of the operations associated with detecting and compensating for the rotation of an inkjet printhead in accordance with one implementation of the present invention.

FIG. 5 provides a flowchart diagram of the operations associated with detecting and compensating for the rotation of an inkjet printhead in accordance with one implementation of the present invention. The detection operation receives an initial image of a pattern taken from a medium as the printhead passes over the medium (502). The initial image of the pattern can be taken once or several times as the printhead passes across the media. For example, it may be necessary to detect several different rotations of the printhead as the printhead passes over the media. A discreet set of rotation measurements can be extrapolated for many more positions along the guide rods. In particular, the processor may then interpolate from the measured theta Z measurements taken at known positions along the scan axis to generate theta Z measurements for each point along the scan axis. This may be done by fitting a curve to the measured values for example. The more known values the more accurately the curve may be fitted. In this manner, Theta Z corrections may be applied across the entire scan axis, or alternately only in places where the theta Z measurement exceeds a given tolerance in the clockwise and anti-clockwise directions. In one implementation, the initial image of the pattern is received at a first time instant from a first photosensor array operatively coupled to the printhead. In one implementation, this first photosensor is part of a MAS also coupled to the printhead and carriage.

Next, a subsequent image of the pattern is taken from the medium as the printhead continues to pass over the medium (504). The subsequent image of the pattern is gathered at a second time instant from a second photosensor also operatively coupled to the printhead. In one implementation, the first photosensor array and second photosensor array are physically separated by a predetermined gap distance and the carriage travels at a known carriage-velocity.

Alternatively, the initial image of the pattern on the media is received at a first time instant from the first photosensor array operatively coupled to the printhead and the subsequent image of the pattern is gathered at a second time instant from the same first photosensor array operatively coupled to the printhead. Pattern information can be taken from a variety of different mediums and media delivery types including rolled mediums, cut-sheet mediums, paper mediums, transparent mediums, plastic mediums, textile mediums, cloth mediums, and metallic mediums.

Once the images are gathered, a comparison is made between the initial image of the pattern and the subsequent image of the pattern taken from the medium (506). The printhead is considered rotated when the pattern found in the initial image is at a first orientation while the same pattern is rotated when the subsequent image containing the pattern is snapped. Of course, if the orientation of the pattern in the initial image matches the orientation of the same pattern in the subsequent image, implementations of the present invention would determine that the carriage and printhead have not been rotated in the theta-z direction between the points along the scan axis at which the measurements were made provided these points are relatively close together.

Results from the comparison, indicates whether the printhead and carriage is rotated in the theta-z direction (508). In the event the printhead is determined to be rotated in the theta-direction, one implementation of the present invention modifies the timing settings associated with the firing of the nozzles in the inkjet printhead to compensate for the rotation of the printhead (510). In an alternative implementation, the data delivered to the printhead for printing is preprocessed to effectively rotate the image and compensate for the printhead rotation. For example, different nozzles are selected to deliver portions of an image onto the media effectively compensating for the printhead rotation without modifying the actual firing of the nozzles. In either implementation, the printer then operates the inkjet printhead for printing output using the modified settings to compensate for the rotation of the printhead in the theta-z direction (512). Alternatively, if the printhead is determined to not be rotated in the theta-z direction, the timing settings associated with the inkjets in the inkjet printhead are not modified. Accordingly, the printhead prints on the media without further modification of the timing settings for the inkjets in the printhead (514).

Figure 6:
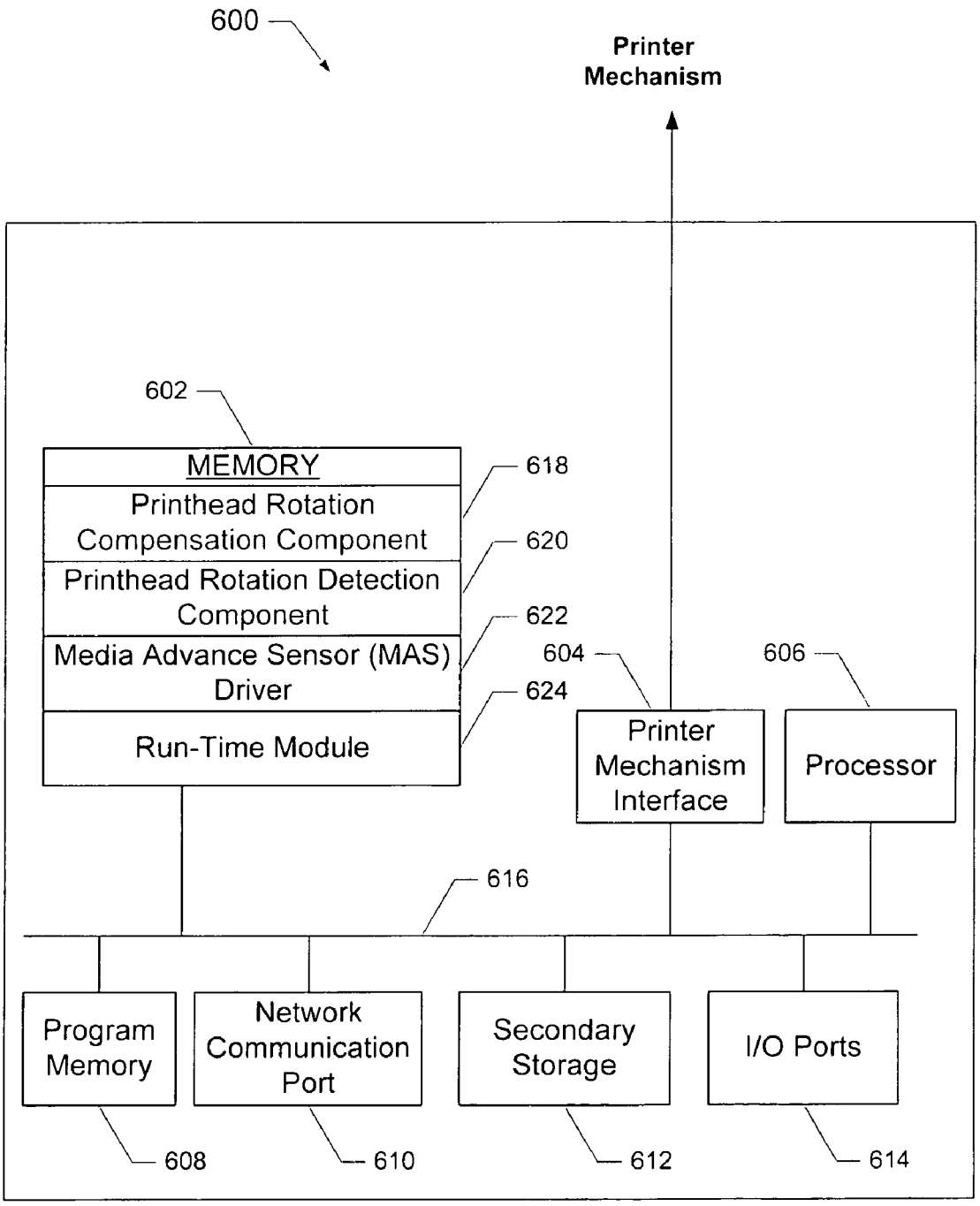
FIG. 6 is a block diagram of a system used in one implementation for performing the apparatus or methods of the present invention.

FIG. 6 is a block diagram of a system 600 used in one implementation for performing the apparatus or methods of the present invention. System 600 includes a memory 602 to hold executing programs (typically random access memory (RAM) or writable read-only memory (ROM) such as a flash ROM), a printer mechanism interface 604 capable of interfacing with one or more photosensors, the MAS, inkjet printheads, the inkjet carriage and other printer components, a processor 606, a program memory 608 for holding drivers or other frequently used programs, a network communication port 610 for data communication, a secondary storage 612 with secondary storage controller, and input/output (I/O) ports 614 also with I/O controller operatively coupled together over a bus 616. The system 600 can be preprogrammed, in ROM, for example, using field-programmable gate array (FPGA) technology or it can be programmed (and reprogrammed) by loading a program from another source (for example, from a floppy disk, a CD-ROM, or another computer). Also, system 600 can be implemented using customized application specific integrated circuits (ASICs).

In one implementation, memory 602 includes a printhead rotation compensation component 618, a printhead rotation detection component 620, a media advance sensor (MAS) driver 622 and a run-time module 626 that manages system resources used when processing one or more of the above components on system 600.

Printhead rotation compensation component 618 is designed to measure and compare the rotation of a pattern as captured in one or more images taken from a medium over a time interval. If a given pattern taken from the medium is rotated, printhead rotation compensation component 618 determines the modification required in firing the nozzles in the printhead to compensate for the printhead rotation. For example, the nozzles fired in a printhead may be further advanced or delayed depending on which direction the inkjet printhead needs to be rotated (i.e., clockwise or counter-clockwise). Alternatively, printhead rotation compensation component 618 may also preprocess data being printed and redirect the data to different nozzles thereby effectively compensating for printhead rotation without modifying the timing used to fire the nozzles.

MAS driver 622 operates the MAS and ensures the information is gathered by one or more photosensors is available. For example, MAS driver 622 may cause the proper lighting or illumination on the medium to make sure the one or more photosensors are able to obtain image and pattern information from the media. Details on operation of the MAS and the functions that MAS driver performs are further described in the U.S. Patent by Tullis as previously described.

While examples and implementations have been described, they should not serve to limit any aspect of the present invention. Accordingly, implementations of the invention can be implemented in digital electronic circuitry, or in computer hardware, firmware, software, or in combinations of them. Apparatus of the invention can be implemented in a computer program product tangibly embodied in a machine-readable storage device for execution by one or more programmable processors; and method steps of the invention can be performed by one or more programmable processors executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors.

Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs.

While specific embodiments have been described herein for purposes of illustration, various modifications may be made without departing from the spirit and scope of the invention. Accordingly, the invention is not limited to the above-described implementations, but instead is defined by the appended claims in light of their full scope of equivalents.

What is claimed is:

1. A method of detecting printhead rotation in an inkjet printer, comprising:

receiving an initial image of a pattern taken from a medium as the printhead passes over a medium;

receiving a subsequent image of the pattern taken from the medium as the printhead continues to pass over the medium;

comparing the initial image of the pattern and the subsequent image of the pattern taken from the medium; and identifying a rotation of the printhead in the inkjet printer passing over the medium if the comparison indicates the initial image of the pattern is rotated relative to the subsequent image of the pattern.

2. The method of claim 1 further comprising:

modifying the timing settings associated with the firing of the nozzles in the inkjet printhead to compensate for the rotation of the printhead.

3. The method of claim 1 further comprising:

redirecting data being printed to different nozzles to effectively compensating for printhead rotation.

4. The method of claim 2 further comprising:

printing on the medium using the modified timing settings for the inkjets in the printhead.

5. The method of claim 1 wherein printhead rotation detection is performed at one or more time intervals as the printhead passes over the medium.

6. The method of claim 1 wherein the printhead rotation occurs around a z-axis substantially perpendicular to a carriage direction.

7. The method of claim 1 wherein the medium is selected from a set of mediums including: a rolled medium, a cut-sheet medium, a paper medium, a transparent medium, a plastic medium, a textile medium, a cloth medium, and a metallic medium.

8. The method of claim 1 wherein the inkjet printhead is selected from a set including: thermal inkjet and piezoelectric inkjet.

9. The method of claim 1 wherein the initial image of the pattern on the media is received at a first time instant from a photosensor array operatively coupled to the printhead and the subsequent image of the pattern is gathered at a second time instant from the same photosensor array operatively coupled to the printhead.

10. The method of claim 9 wherein the photosensor does not completely pass over the pattern in the time interval between the first time instant and the second time instant.

11. The method of claim 1 wherein the initial image of the pattern is received at a first time instant from a first photosensor array operatively coupled to the printhead and the subsequent image of the pattern is gathered at a second time instant from a second photosensor array also operatively coupled to the printhead, wherein the first photosensor array and second photosensor array are physically separated by a predetermined gap distance and the carriage travels at a known carriage-velocity.

12. The method of claim 10 wherein the difference between the second time instant and the first time instant is proportional to the predetermined gap distance divided by the carriage-velocity.

13. An inkjet printer capable of detecting printhead rotation, comprising:

a carriage guided by at least one carriage guidebar carrying at least one printhead and advanced by a carriage drive motor;

at least one photosensor coupled to the carriage that receives an initial image of a pattern taken from a medium as the printhead passes over a medium and a subsequent image of the pattern taken from the medium as the printhead continues to pass over the medium; and a printer controller configured to compare the initial image of the pattern and the subsequent image of the pattern taken from the medium and identify a rotation of the printhead in the inkjet printer passing over the medium if the comparison indicates the initial image of the pattern is rotated relative to the subsequent image of the pattern.

14. The inkjet printer of claim 13 wherein the printer controller is further configured to modify the timing settings associated with the firing of the nozzles in the inkjet printhead to compensate for the rotation of the printhead.

15. The inkjet printer of claim 13 wherein the printer controller is further configured to redirect data being printed to different nozzles to effectively compensate for printhead rotation.

16. The inkjet printer of claim 14 wherein the printer controller is further configured to print on the medium using the modified timing settings for the inkjets in the printhead.

17. The inkjet printer of claim 13 wherein the printer controller detects the printhead rotation at one or more time intervals as the printhead passes over the medium.

18. The inkjet printer of claim 13 wherein the printhead rotation occurs around a z-axis substantially perpendicular to a carriage direction.

19. The inkjet printer of claim 13 wherein the medium is selected from a set of mediums including: a rolled medium, a cut-sheet medium, a paper medium, a transparent medium, a plastic medium, a textile medium, a cloth medium, and a metallic medium.

20. The inkjet printer of claim 13 wherein the inkjet printhead is selected from a set including: thermal inkjet and piezoelectric inkjet.

21. The inkjet printer of claim 13 wherein the at least one photosensor coupled to the carriage is limited to a single photosensor that receives an initial image of the pattern on the media at a first time instant and then receives a subsequent image of the pattern gathered at a second time instant.

22. The inkjet printer of claim 13 wherein the at least one photosensor coupled to the carriage is limited to a first photosensor array operatively coupled to the printhead that receives a pattern at a first time instant and a second photosensor array also operatively coupled to the printhead that gathers the subsequent image of the pattern at a second time instant from, wherein the first photosensor array and second photosensor array are physically separated by a predetermined gap distance and the carriage travels at a known carriage-velocity.

23. The inkjet printer of claim 13 operatively coupled over a network and available for printing by one or more computer systems.

24. A computer program product for detecting printhead rotation in an inkjet printer, tangibly stored on a computer-readable medium, comprising instructions operable to cause a programmable processor to:

receive an initial image of a pattern taken from a medium as the printhead passes over a medium;

receive a subsequent image of the pattern taken from the medium as the printhead continues to pass over the medium;

compare the initial image of the pattern and the subsequent image of the pattern taken from the medium; and identify a rotation of the printhead in the inkjet printer passing over the medium if the comparison indicates the initial image of the pattern is rotated relative to the subsequent image of the pattern.

25. The computer program product of claim 24 further comprising instructions operable to cause a programmable processor to:

modify the timing settings associated with the firing of the nozzles in the inkjet printhead to compensate for the rotation of the printhead.

26. The computer program product of claim 24 further comprising instructions operable to cause a programmable processor to:

redirect data being printed to different nozzles to effectively compensating for printhead rotation.

27. The computer program product of claim 24 wherein the medium is selected from a set of mediums including: a rolled medium, a cut-sheet medium, a paper medium, a transparent medium, a plastic medium, a textile medium, a cloth medium, and a metallic medium.

28. The computer program product of claim 24 wherein the inkjet printhead is selected from a set including: thermal inkjet and piezoelectric inkjet.

29. An apparatus for detecting printhead rotation in an inkjet printer, comprising:

means for receiving an initial image of a pattern taken from a medium as the printhead passes over a medium;

means for receiving a subsequent image of the pattern taken from the medium as the printhead continues to pass over the medium;

means for comparing the initial image of the pattern and the subsequent image of the pattern taken from the medium; and identifying a rotation of the printhead in the inkjet printer passing over the medium if the comparison indicates the initial image of the pattern is rotated relative to the subsequent image of the pattern.

30. The apparatus of claim 29 further comprising:

means for modifying the timing settings associated with the firing of the nozzles in the inkjet printhead to compensate for the rotation of the printhead.

31. The apparatus of claim 29 further comprising:

means for redirecting data being printed to different nozzles to effectively compensate for printhead rotation.

* * * * *